United States Patent [19]

Hollis

[11] Patent Number: 5,004,234

[45] Date of Patent: Apr. 2, 1991

[54] ADJUSTABLE BATTING TEE

[76] Inventor: Ray A. Hollis, 6715 Greenvale La., Houston, Tex. 77066

[21] Appl. No.: 534,030

[22] Filed: Jun. 6, 1990

[51] Int. Cl.[5] ..... A63B 69/40

[52] U.S. Cl. ..... 273/26 R; 273/29 A

[58] Field of Search ..... 273/26 R, 29 A, 191 R

[56] References Cited

U.S. PATENT DOCUMENTS

| | | | |
|---|---|---|---|
| 3,489,411 | 1/1970 | Morelli et al. | 273/26 R |
| 4,383,686 | 5/1983 | Cardieri | 273/26 R |
| 4,456,250 | 6/1984 | Perrone, Jr. | 273/26 R |
| 4,664,374 | 5/1987 | Groves | 273/26 R |
| 4,709,924 | 12/1987 | Wilson et al. | 273/26 R |
| 4,819,937 | 4/1989 | Gordon | 273/26 R |
| 4,886,267 | 12/1990 | Licciardi | 273/26 R |

*Primary Examiner*—Theatrice Brown

*Attorney, Agent, or Firm*—Browning, Bushman, Anderson & Brookhart

[57] ABSTRACT

A home plate having a pair of spaced apart, open slots are used in conjunction with a horizontal support member having an pedestal at each end and a single open slot along its length. A pair of bolt and wingnut combinations are used in the slots, thus connecting the horizontal support member to the home plate. A batting tee connected to one of the pedestals is thus infinitely movable with respect to the home plate.

2 Claims, 2 Drawing Sheets

ADJUSTABLE BATTING TEE

BACKGROUND OF THE INVENTION

1. Field of the Invention

This invention relates, generally, to an improved batting or practice hitting tee. More particularly, the invention relates to a baseball or softball practice or hitting tee which can be adjusted by the coach or hitter to many positions with respect to the home plate.

2. Description of the Background

In the game of baseball, one of the most difficult skills to master is hitting. First, a hitter must be able to coordinate the swing of the bat with the location of the ball so that good contact with the ball can be made while swinging the bat. Once this is mastered, the hitter must next learn to make good contact with the ball at the various positions at which it may cross home plate, from an inside pitch to an outside pitch, and from a high pitch to a low pitch, and various combinations of these two variables.

In development of these skills, the trainer or coach uses a baseball tee to support the ball at a selected height above a representation of the baseball home plate. With the ball so positioned, the batter can practice swinging thereat to assist in the process of coordinating his hands with his eyes and in the development of his wrist and arm muscles.

Various practice batting tees have been developed in the past for this purpose. The practice tees developed to date, however, have had various limitations which have limited their overall acceptance in the baseball world. In some cases, the tees have not been adjustable and different tees must be used for different hitting zones. In other cases the tees have been partially adjustable, but not able to cover all the hitting zones. In many cases, the tees have been adjustable, but the adjustment has required considerable time and manipulation to place the tee in the desired position. In other cases, the tees have been very expensive to produce, and the cost has been prohibitive for many of the teams.

Exemplary of the prior art are U.S. Pat. Nos. 3,489,411: 4,709,924; 4,664,374: and 4,383,686.

U.S. Pat. No. 3,489,411 to Morelli et al, for example, disclose what is essentially a solid home plate and uses a horizontal support member having a slot along its length. Morelli et al attempt to provide additional tee adjustment by causing the slotted member to pivot about a single point anchored in the home plate.

U.S. Pat. No. 4,709,924 to Wilson et al also disclose a slotted horizontal support member which is used in a manner similar to that of U.S. Pat. No. 3,489,411. However, instead of pivoting around an end point of the horizontal arm as disclosed in Morelli et al, Wilson et al cause the horizontal arm to pivot about a centralized pivot point 46 which itself is in the slot of the horizontal arm.

U.S. Pat. No. 4,664,374 to Groves also uses a slotted horizontal support member, but which also uses a pivoting L-shaped member attached to the slotted support member.

U.S. Pat. No. 4,383,686 to Cardieri shows two or more parallel plates using spacers therebetween to effect positioning of the tee.

Each of the foregoing prior art batting tees has a common disability, in that none of them, alone or in combination, suggest the use of one or more slots in the home plate itself, used in conjunction with the slotted horizontal support member to optimize and facilitate the placement of the batting tee with respect to the home plate. The prior art which causes the horizontal arm to pivot about a single point, as characterized by Morelli et al U.S. Pat. No. 3,489,411 and Wilson et al U.S. Pat. No. 4,709,924, is further deficient in that only a slight pressure to the vertical tee can cause the horizontal arm to pivot and thus create an unwanted repositioning of the tee.

It is therefore the primary object of the present invention to provide a new and improved batting tee having an increased variability of the batting tee with respect to the home plate.

It is another object of the invention to provide a new and improved batting tee have increased stability of the batting tee with respect to the home plate.

SUMMARY OF THE INVENTION

The objects of the invention are accomplished, generally, by the provision of a home plate having at least one slot and a horizontal support member having a batting tee pedestal at one of its ends and also having at least one slot, and the provision of fastener means in each of said slots to provide vastly improved variability and stability of the horizontal support member with respect to the home plate. As an additional feature, a second batting tee pedestal is provided at the other end of the horizontal support member.

BRIEF DESCRIPTION OF THE DRAWINGS

The various objects, features and advantages of the present invention will be more fully appreciated and understood by reference to the accompanying drawings, in which.

DETAILED DESCRIPTION OF THE DRAWINGS

Figure 1:
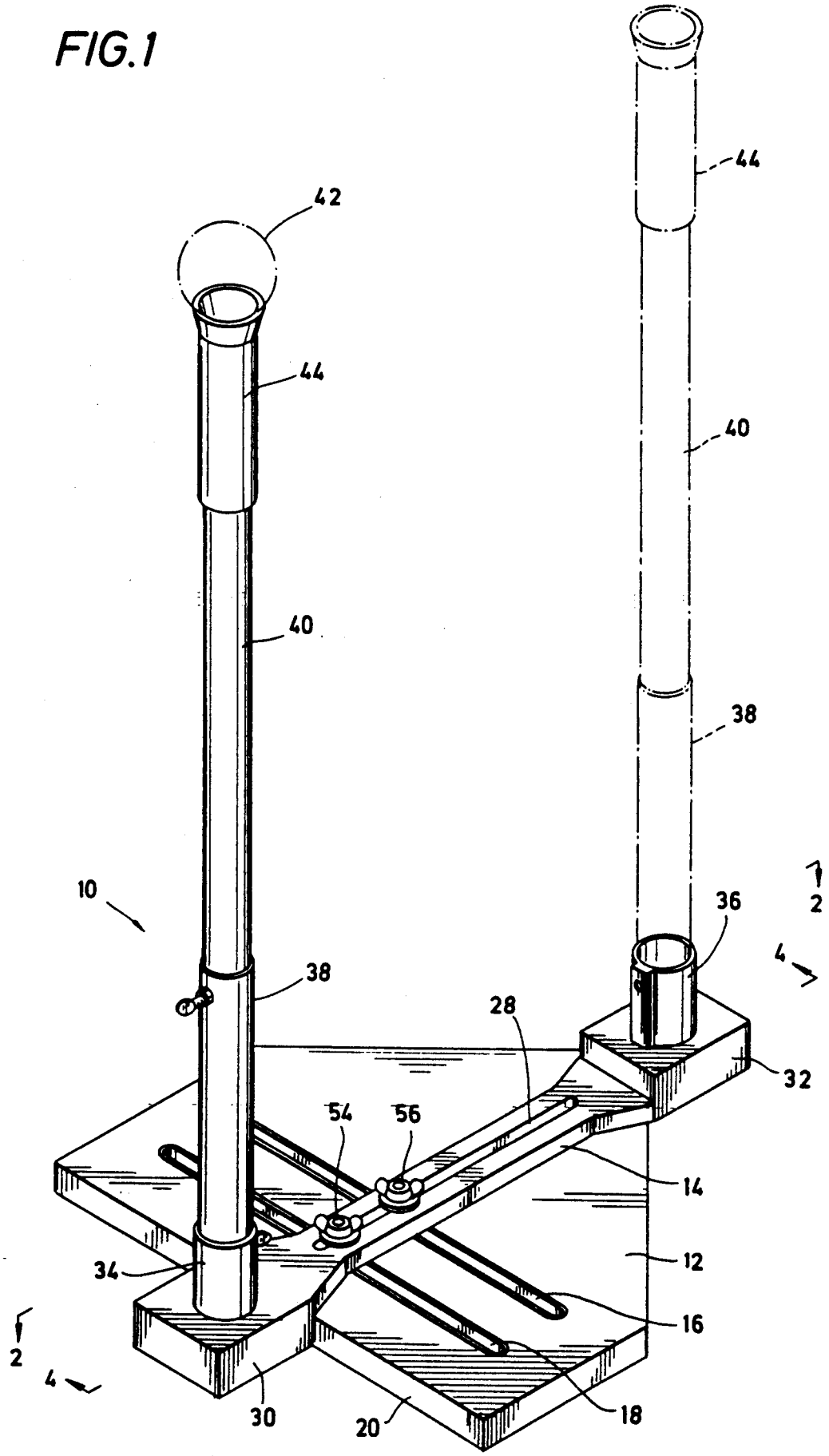
FIG. 1 is an elevated, pictorial view of the batting tee according to the present invention.

Referring now to FIGS. 1–4, the batting tee 10 includes a home plate 12 and a horizontal support member 14. The home plate 12, shaped and sized like the conventional home plate used in baseball and softball games, has a pair of open slots 16 and 18, each of whose longitutudinal axis, respectively, is perpendicular to a straight, imaginary line running between the mid-point of the side 20 of the home plate and the converging point 22 of sides 24 and 26, best illustrated in FIG. 3. In a typical home plate which can be used in accordance with the invention, the side 20 of the home plate will be 17" wide and each of the elongated slots 16 and 18 will be 13" long. The slots 16 and 18 will each be approximately ½" wide to accommodate the bolts 50 and 52, respectively.

Figure 2:
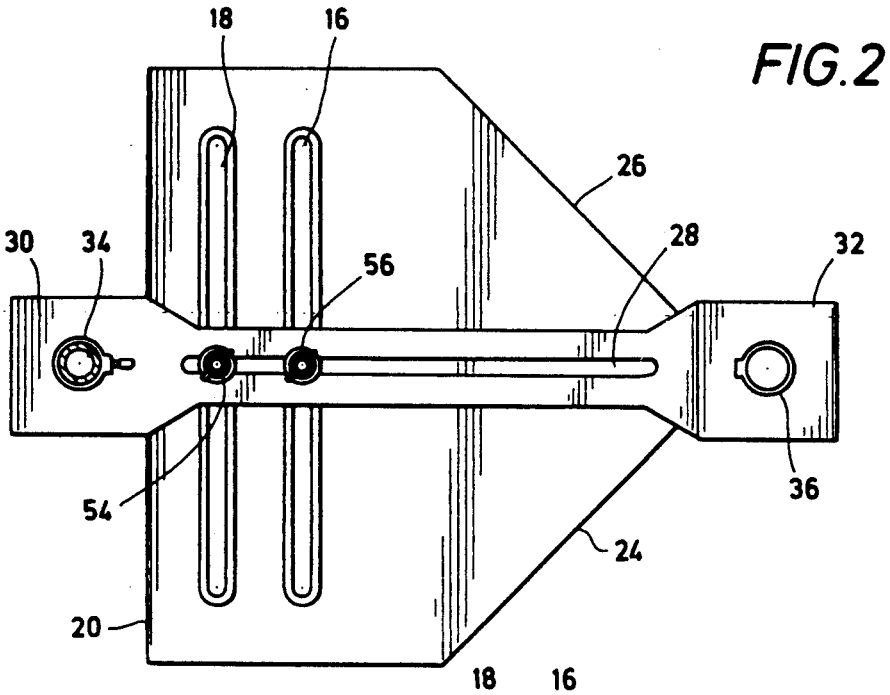
FIG. 2 is a plan view of the top of the batting tee according to the present invention taken along the section line 2—2 of FIG. 1.
Figure 3:
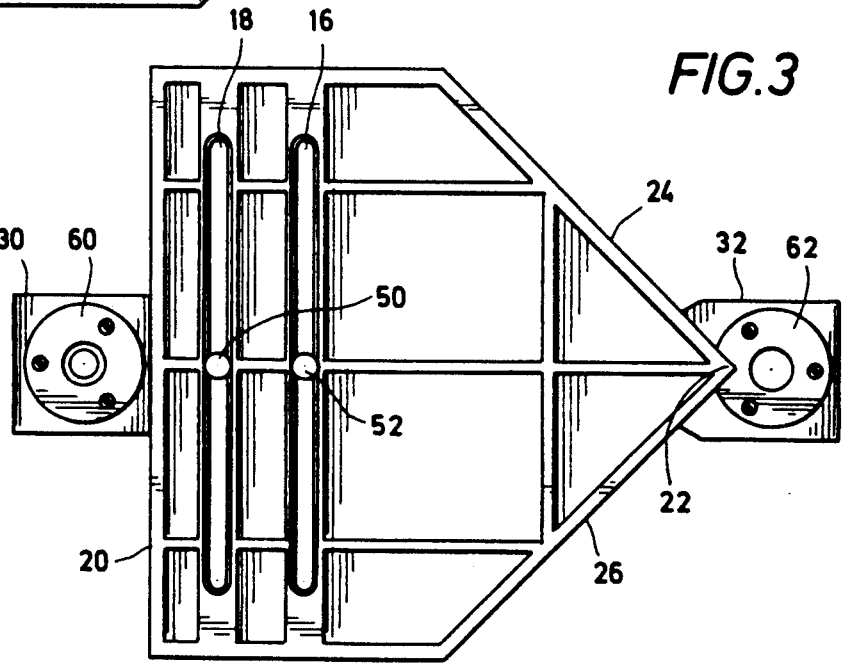
FIG. 3 is a plan view of the bottom of the batting tee according to the present invention.
Figure 4:
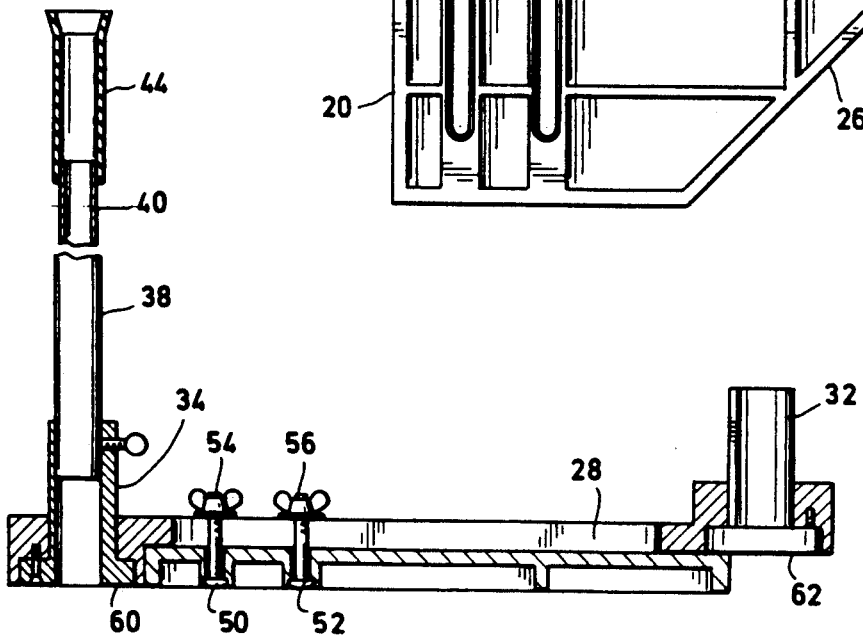
FIG. 4 is an elevated view, partly in cross-section, of the batting tee according to the present invention taken along the section line 4—4 of FIG. 1.

The horizontal support member 14 has a single open slot 28 running along a substantial portion of its length. As illustrated in FIGS. 1–3, the longitudinal axis of the slot 28 is essentially co-incident with the above-described imaginary line between the converging point 22 and the mid-point of side 20, but in use, the slot 28 will often times lie at another angle across the slots 16 and 18. The typical elongated slot 28 will be approximately 12" long and ½" wide to accommodate the bolts 50 and 52. It should be appreciated, however, that the dimensions of the home plate and of the horizontal support member are merely exemplary, as are the dimensions of the elongated slots 16, 18 and 28.

The horizontal support member 14 has a first pedestal 30 at one end and a second pedestal 32 at its other end. A first lower post 34 is connected to the pedestal 30 and a second lower post 36 is connected to pedestal 32. Each of the posts 34 and 36 has a lower plate, identified as 60 and 62, respectively, as illustrated in FIG. 3, with the plates 60 and 62 mounted to the lower sides of pedestals 30 and 32, respectively. A telescoping member 38, 40 is connected to the post 34 in the conventional manner to adjust the vertical heighth of the baseball 42, which is placed in the conventional rubber cup 44 connected to the telescoping member 40. If desired, the unit (38, 40, 44) can be attached to the post 36 instead of to the post 34. Alternatively, a pair of such units can be used with the posts 34 and 36, respectively.

First and second bolts 50 and 52 are used in the slots 16, 18 and 28, and are held in place by wingnuts 54 and 56, respectively.

In the operation of the assembly described hereinabove, the wingnuts 54 and 56 or other similar fastener means are first loosened. The horizontal support member 14 can then be moved along the slots 16 and 18, either straight across the width of the home plate or at an angle thereto, and/or along the slot 28, thus providing essentially an infinite number of positions for the baseball 42 with respect to the home plate 12. Once in position, the wingnuts 54 and 56 are tightened, and the batting tee is ready for use.

It should be appreciated that, in addition to providing additional adjustability of the tee with respect to the home plate, the invention also provides a vastly superior stability of the horizontal support member with respect to the home plate because of using the two fastener mechanisms, as contrasted with the use of a single fastener which would tend to make the horizontal support member pivot about the fastener with only the slightest pressure, such as, for example, the bat hitting the tee instead of the ball. Thus, although the invention comtemplates the use of a single open slot (16 or 18) in the home plate 12, the preferred embodiment comprises the use of the two slots 16 and 18.

Alternative embodiments of the invention will become readily apparent from a reading of the foregoing. For example, instead of using two or more slots in the home plate and only a single slot in the horizontal support member to provide stability, the invention contemplates the use of a single slot (16 or 18) in the home plate and a pair of parallel slots in the horizontal support member. Also, the horizontal support member may be constructed such that the one or more pedestals are at locations along the length thereof, as contrasted with being at the opposite ends of the horizontal support member.

What is claims is:

1. An adjustable batting tee, comprising:

a home plate having first and second open slots, said slots being parallel and spaced apart:

a horizontal support member of a given length and having first and second ends and also having a first pedestal at one of its said ends and having a third open slot along at least a portion of the length of said horizontal support member, said first pedestal having means to mount a batting tee thereto;

first and second fastener means connecting said horizontal support member to said home plate, the first said fastener means being in said first slot, the second said fastener means being in said second slot, and each of said first and second fastener means being in said third slot, whereby upon loosening said first and second fastener means, said first pedestal can be re-positioned with respect to said home plate.

2. The adjustable batting tee according to claim 1, including in addition thereto, a second pedestal on the other end of said horizontal support member, said second pedestal having means to mount a batting tee thereto.

* * * * *